US010113743B2

(12) United States Patent
Andersen

(10) Patent No.: US 10,113,743 B2
(45) Date of Patent: Oct. 30, 2018

(54) MOTOR-DRIVEN CHIMNEY DRAFT SYSTEM

(71) Applicant: exodraft a/s, Odense SØ (DK)

(72) Inventor: Jørgen Andersen, Odense (DK)

(73) Assignee: exodraft a/s, Odense SØ

( * ) Notice: Subject to any disclaimer, the term of this patent is extended or adjusted under 35 U.S.C. 154(b) by 262 days.

(21) Appl. No.: 14/981,556

(22) Filed: Dec. 28, 2015

(65) Prior Publication Data

US 2016/0186993 A1 Jun. 30, 2016

(30) Foreign Application Priority Data

Dec. 30, 2014 (EP) ..... 14200538

(51) Int. Cl.

| | |
|---|---|
| ***F23L 17/00*** | (2006.01) |
| ***F23J 11/12*** | (2006.01) |
| ***F23J 13/08*** | (2006.01) |
| ***F23L 17/02*** | (2006.01) |
| ***F23J 3/02*** | (2006.01) |

(52) U.S. Cl.

CPC ..... *F23L 17/005* (2013.01); *F23J 3/026* (2013.01); *F23J 11/12* (2013.01); *F23J 13/08* (2013.01); *F23L 17/02* (2013.01)

(58) Field of Classification Search

USPC ..... 454/16, 5, 8, 15

See application file for complete search history.

(56) References Cited

U.S. PATENT DOCUMENTS 3,782,303 A 1/1974 Pfister et al.
5,070,772 A * 12/1991 Guzorek ..... F23L 17/005 110/162

(Continued)

FOREIGN PATENT DOCUMENTS

CN 2871928 Y 2/2007
DE 2607712 A1 * 9/1977 ..... F23L 17/005

(Continued)

OTHER PUBLICATIONS

DE2607712MT; machine translation of DE2607712A1.*
JPS63194119MT; machine translation of JP63194119A.*
DE4001849MT; machine translation of DE4001849A1.*

*Primary Examiner* — Gregory Huson
*Assistant Examiner* — Elizabeth M May
(74) *Attorney, Agent, or Firm* — Knobbe Martens Olson & Bear LLP

(57) ABSTRACT

The invention provides a motor-driven chimney draft system with a flue gas inlet, a flue gas outlet, a flue gas compartment in fluid communication with the flue gas inlet and with the flue gas outlet, the flow of flue gases in the flue gas compartment having a flow direction from the flue gas inlet to the flue gas outlet, a motor compartment with motor having a motor shaft extending through a separating wall of the flue gas compartment, the motor shaft carrying an impeller for driving the received flow of flue gases in the flow direction; each of the separating wall of the flue gas compartment and the separating wall of the motor compartment extends parallel to the flow direction of flue gases, and they are arranged facing each other so as to define an air space therebetween, where the air space has openings allowing ambient air to flow through the air space.

8 Claims, 3 Drawing Sheets

(56) References Cited

U.S. PATENT DOCUMENTS

| | | | | |
|---|---|---|---|---|
| 5,439,349 | A * | 8/1995 | Kupferberg | F04D 29/4246 415/212.1 |
| 7,018,287 | B2 | 3/2006 | Kupferberg et al. | |
| 2012/0083194 | A1 * | 4/2012 | Hagensen | F23J 11/02 454/16 |

FOREIGN PATENT DOCUMENTS

| | | | | |
|---|---|---|---|---|
| DE | 4001849 | A1 * | 7/1991 | F23L 11/00 |
| DE | 197 55 617 | A1 | 6/1999 | |
| EP | 2 594 847 | A1 | 5/2013 | |
| JP | 63194119 | A * | 8/1988 | |
| JP | H06347021 | A | 12/1994 | |

* cited by examiner

MOTOR-DRIVEN CHIMNEY DRAFT SYSTEM

CROSS-REFERENCE TO RELATED APPLICATIONS

This application claims the benefit of priority to European Patent Application No. 14200538.8 filed on Dec. 30, 2014, which is hereby expressly incorporated by reference in its entirety.

BACKGROUND OF THE INVENTION

Field of the Invention

The invention relates to motor-driven chimney draft systems used for assisting or supplementing the thermally induced draft in a chimney.

Description of the Related Art

Motor-driven chimney draft systems are used when the thermally induced chimney draft is insufficient. This is the case when the temperature in the chimney has not yet reached a level where the thermally induced draft is sufficient for a proper combustion and operation of the system. A motor-driven chimney draft system supplements an insufficient thermally induced draft, and the forced draft increases the flow of flue gases which are removed from a furnace, a stove or other fireplace, which in turn draws fresh air into the furnace to support the combustion. After some time the combustion may have reached a stage where the thermally induced draft is sufficient and the motor-driven chimney draft system can be deactivated.

In existing motor-driven chimney draft systems the flue gases are forced to change flow direction which increases the flow resistance, which is undesirable.

Flue gases can be very hot, and although some cooling will take place on their way from the fireplace to the flue gas outlet of the chimney, the flue gases can still be hot when leaving the flue gas outlet of the chimney. Chimney draft system including its motor must therefore be constructed to operate at elevated temperatures caused by the flue gases.

It is desirable that motor-driven chimney draft systems add as little as possible flow resistance to the flow path of flue gases. It is also desirable that the motor is protected from excessive heating by the flue gases so that no arrangements, or only cost-effective arrangements, need be taken for preventing excessive heating of the motor.

SUMMARY OF THE INVENTION

The invention provides a motor-driven chimney draft system with a flue gas inlet, a flue gas outlet, a flue gas compartment in fluid communication with the flue gas inlet and with the flue gas outlet, the flow of flue gases in the flue gas compartment having a flow direction from the flue gas inlet to the flue gas outlet, a motor compartment with motor having a motor shaft extending through a delimiting wall of the flue gas compartment, the motor shaft carrying an impeller for driving the received flow of flue gases in the flow direction; each of the delimiting wall of the flue gas compartment and the delimiting wall of the motor compartment extends parallel to the flow direction of flue gases, and they are arranged facing each other so as to define an air space therebetween, where the air space has openings allowing ambient air to flow through the air space.

The distance between the delimiting walls reduces heat transfer from the flue gas compartment to the motor compartment, and access by the ambient air to the space will give rise to thermally induced convection, in particular when the space is oriented vertically and is open upwardly.

With this structure the flow direction of the flue gases received from a chimney is maintained with a minimal disturbance also when the motor-driven impeller is inactive, and the motor-driven chimney draft system therefore exhibits a minimal flow resistance to the flue gases.

Preferably, the motor shaft (15) extends through both delimiting walls so that the flue gas compartment and the motor compartment are separated by two delimiting walls with a space therebetween.

Advantageously, the motor-driven chimney draft system has a motor compartment housing the motor situated laterally relative to the flow direction and separated from the flow of flue gases by a delimiting wall extending parallel to the flow direction, the motor shaft extending through the delimiting wall in a direction transverse to the flow direction. Thereby the flow of flue gases will be undisturbed by the motor compartment.

In the motor-driven chimney draft system system according to the invention the impeller preferably drives the flue gases in radial directions of the impeller, and comprises a screen arranged on the delimiting wall of the flue gas compartment, where the screen extends from the delimiting wall of the flue gas compartment upstream of the impeller and has a portion which, on a side of the impeller opposite the delimiting wall of the flue gas compartment, extends in the downstream direction and covers a peripheral portion of the impeller blades upstream of the motor shaft.

Preferably, the flue gas compartment has a cover which can be opened to allow access to the flue gas compartment, e.g. for cleaning by a chimney sweep or inspection, service and maintenance.

Preferably, a motor compartment housing the motor is situated laterally relative to the flow direction and separated from the flow of flue gases by a delimiting wall extending parallel to the flow direction with the motor shaft extending through the delimiting wall in a direction transverse to the flow direction.

DETAILED DESCRIPTION OF THE PREFERRED EMBODIMENT

The figures show a motor-driven chimney draft system for mounting on top of a chimney leading flue gases from a fireplace such as a stove. In the shown embodiment the system has a generally cylindrical shape.

Figure 2:
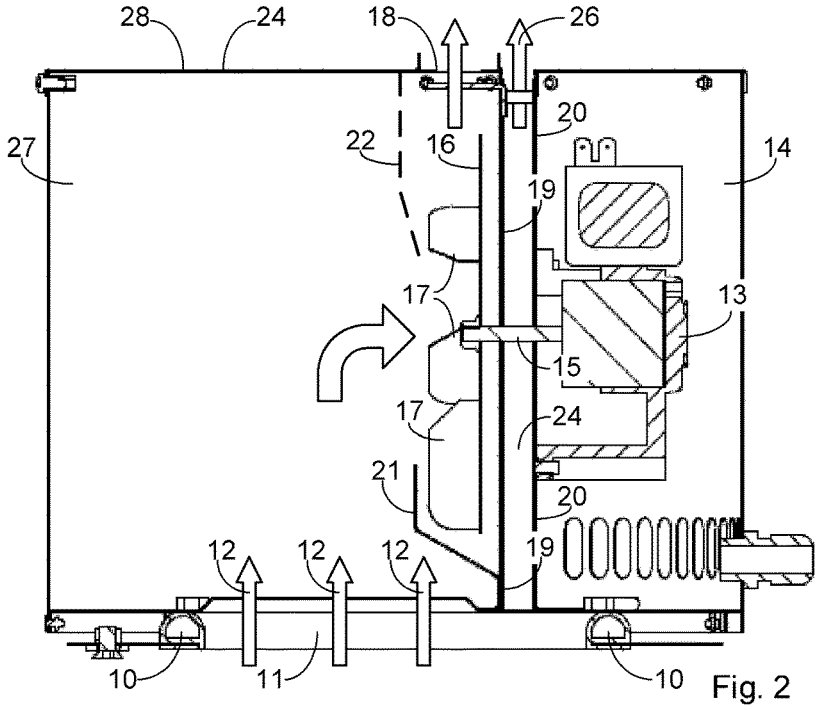
FIG. 2 is a vertical section through the chimney draft system in FIG. 1 taken along the line A-A.
Figure 4:
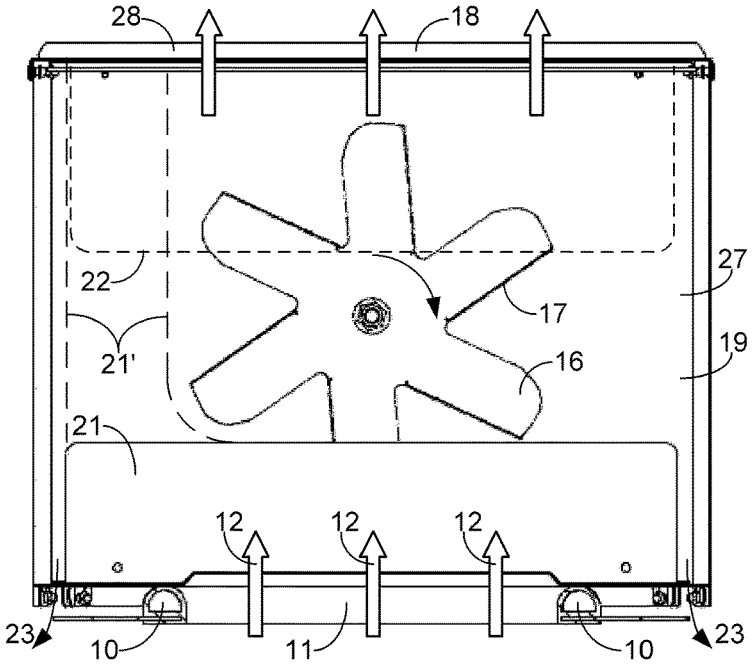
FIG. 4 is a vertical section through the chimney draft system in FIG. 3 taken along the line B-B.

In FIGS. 2 and 4 are shown a fitting device 10 at the bottom of the system which is used for fitting the system to the top of a chimney so that a flue gas inlet 11 of the system can receive a flow 12 of flue gases from the chimney. The flow of flue gases have a flow direction indicated by arrows which is the same flow direction as in in the chimney. A motor compartment 14 of the system houses a motor 13 which has a motor shaft 15 carrying an impeller 16 with impeller blades 17, in this embodiment six impeller blades 17, for driving the received flow of flue gases out through a flue gas outlet 18 at the top of the system. As shown, the motor compartment 14 is situated laterally relative to the flow direction of flue gases and is separated from the flow of flue gases by two delimiting walls 19, 20 each extending parallel to the flow direction of flue gases. The motor shaft 15 extends through the delimiting walls 19, 20 in the horizontal direction, i.e. transverse to the flow direction of flue gases. When the impeller 16 is driven by the motor 13 the impeller blades 17 will expel the flue gases in radial directions relative to the impeller in a radial direction of the impeller, and flue gases will be sucked by the impeller 16 in its axial direction as indicated by a curved arrow.

A screen 21 is mounted on the delimiting wall 19 on the upstream side of the impeller (here: below the impeller) and extends from the delimiting wall 19 on the upstream side of the impeller 16 and has a portion which extends in the downstream direction (here: upward) on the suction side of the impeller 16 and covers a peripheral portion of some of the impeller blades 17 and leaves a central suction zone uncovered.

When the impeller 16 is driven in rotation by the motor 13 the impeller blades 17 will drive flue gases in all radial directions away from the shaft 15, and a central zone will act as a suction zone and suck flue gases in the flue gas compartment 27 towards the suction zone. The screen 21 blocks a radial flow path from the impeller 16 in the upstream direction (here: downward) towards the flue gas inlet 11, and the screen 21 thereby prevents flue gases and air from being blown out through the flue gas inlet 11, i.e. in the undesired reverse direction. Flue gases which are sucked toward the central suction zone will consequently be blown in the downstream direction (here: upward) and out through the flue gas outlet 18 as indicated by an arrow at the flue gas outlet 18.

The impeller 16 will also cause a vortex with a rotational movement of the flue gases in the direction of rotation of the impeller. The screen can therefore advantageously be asymmetric and have a unilateral portion extending in the downstream direction as indicated by a dashed line 21'. The portion of flue gases between the delimiting wall 19 of the flue gas compartment 27 and the lateral portion 21' of the screen 21 are moving in the desired downstream direction, and the lateral portion 21' of the screen 21 separates this downstream flowing portion of the flue gases from the flue gases in the remaining part of the flue gas compartment whereby mixing is prevented or at least reduced with the effect that the efficiency of the system is further increased.

In a typical situation of use the flue gas outlet 18 faces upward and in order to prevent rain entering the system through the flue gas outlet 18 from reaching the chimney through the flue gas inlet 11 an optional rain screen 22 shown in dashed line can be arranged at the top wall of the system and extending downward into the flue gas compartment 27. If present, the lower edge of the rain screen 22 will preferably be closer to the delimiting wall 19 than is the upper edge of the screen 21, so that water dripping from the rain screen 22 will be caught by the screen 21 and can be drained from the system as indicated by arrows 23 in FIG. 4. The size and shape of the rain screen 22 shown in FIGS. 2 and 4 are only for illustrative purposes.

Since the flue gas inlet 11 and the flue gas flue gas outlet 18 are substantially aligned with no or negligible changes in direction or sharp edges that would increase the flow path resistance. Therefore, when the motor 13 is inactive the system will have only negligible influence on the flow.

The top wall 28 of the flue gas compartment 27 is hinged and can be opened to give access to for inspection and easy cleaning by a chimney sweep.

The motor compartment 14 is separated from the flue gas compartment 27 by a vertical air space 24 defined by the delimiting walls 19, 20 which are at a distance from each other. The air space 24 is closed downwardly whereby flue gases cannot enter into the air space 24, and the air space 24 has one or more peripheral openings to the ambient at the two opposite vertical sides or, preferably, also upwardly i.e. at all three of the other sides allowing ambient air to flow through the air space 24.

Figure 1:
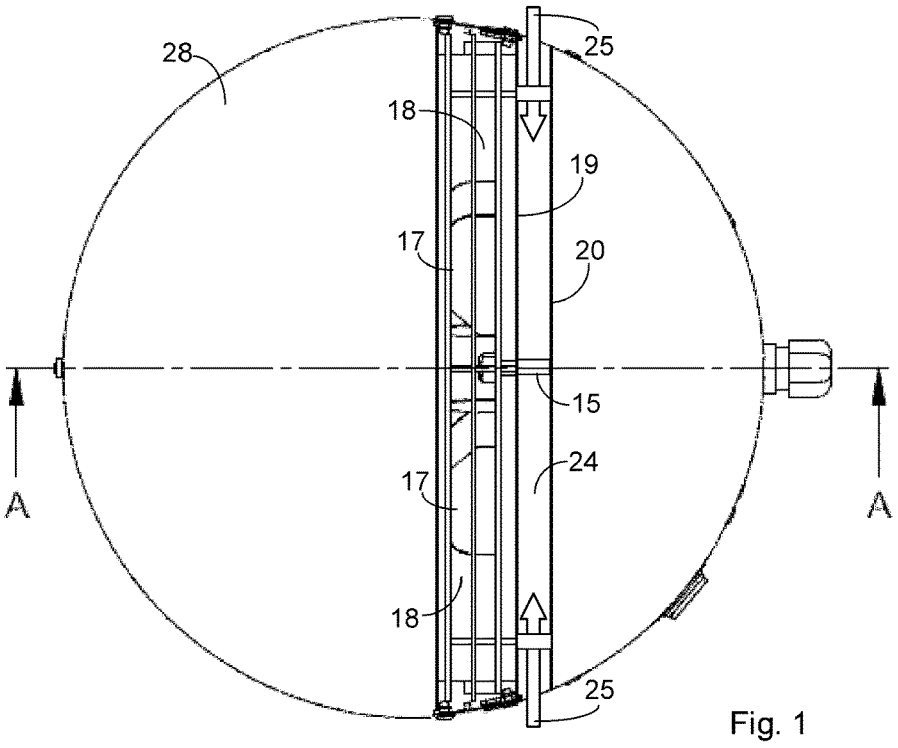
FIG. 1 shows a motor-driven chimney draft system according to the invention seen from above.
Figure 3:
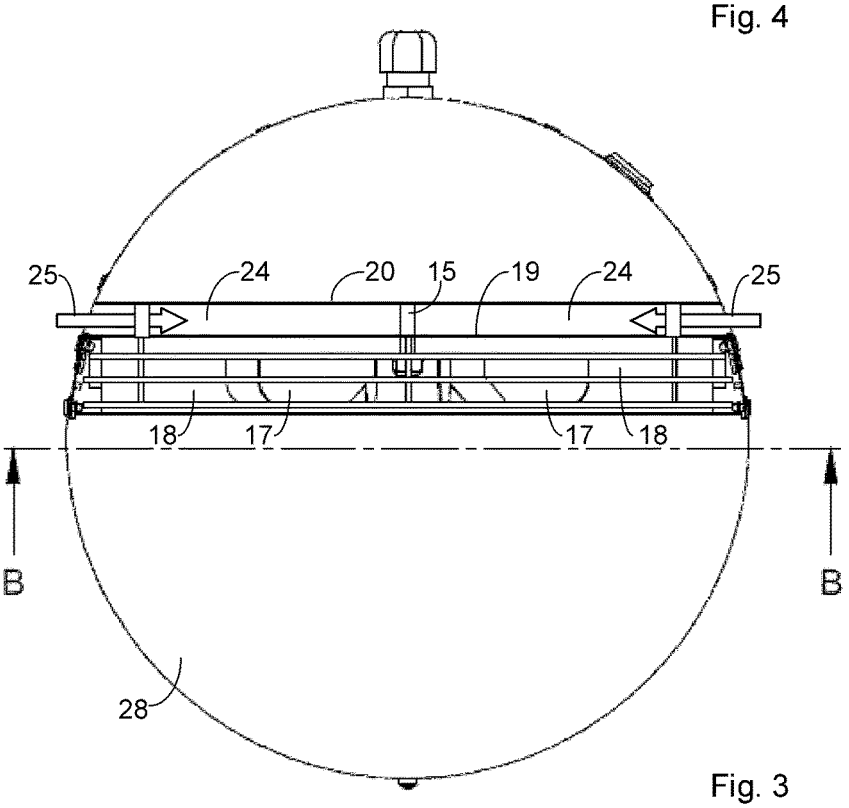
FIG. 3 corresponds to FIG. 1.
Figure 5:
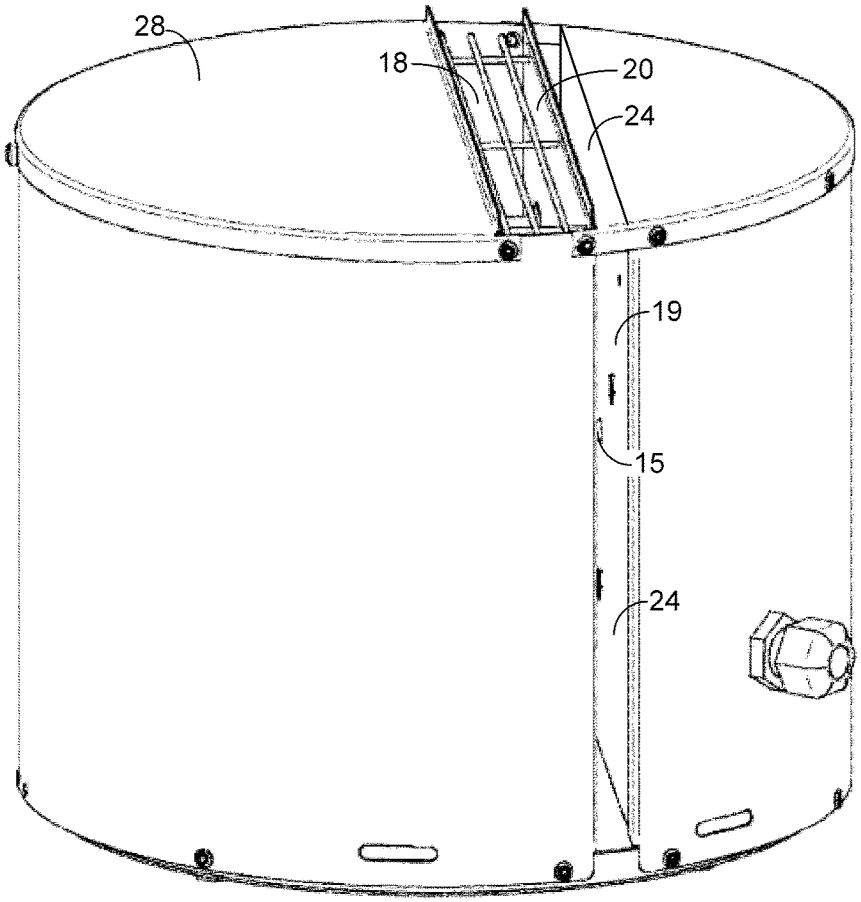
FIG. 5 is a perspective view of the chimney draft system in FIGS. 1-4.

Flue gases in the flue gas compartment 27 will heat the delimiting wall 19 and air in the air space 24 which is in contact with the delimiting wall 19 will be heated, which will cause thermally induced convection whereby ambient air will be drawn into the air space 24 from the sides as indicated by arrows 25 in FIGS. 1 and 3 and leave the air space 24 in an upward direction as indicated by arrow 26 in FIG. 2. In the shown typical situation of use the air space 24 is oriented vertically which enhances thermally induced convection.

The distance between the delimiting walls 19, 20 will in itself reduce heat transfer from the flue gas compartment 27 to the motor compartment 14, and the thermally induced convection will have a cooling effect. Furthermore, wind will have access to the air space 24 and provide cooling. Finally, because the flue gas outlet 18 and the upper opening of the air space 24 are close to each other over almost the entire diameter of the system, the flue gas flow out of the flue gas outlet 18 will also draw air out through the upper opening of the air space 24. If desired, the motor shaft can carry an impeller in the air space 24 for assisting the thermally induced convection.

What is claimed is:

1. A motor-driven chimney draft system comprising:

a flue gas inlet for receiving a flow of flue gases, a flue gas outlet for discharging the flow of flue gases, a flue gas compartment delimited by a flue gas compartment wall, the flue gas compartment being in fluid communication with the flue gas inlet and with the flue gas outlet, a motor compartment delimited by a motor compartment wall, the motor compartment housing a motor having a motor shaft extending through the motor compartment wall and through the flue gas compartment wall, the motor shaft carrying an impeller situated in the flue gas compartment for driving the received flow of flue gases in a flow direction from the flue gas inlet to the flue gas outlet, wherein the flue gas compartment wall and the motor compartment wall are arranged at a distance from and facing each other so as to define an air space oriented vertically therebetween and closed downwardly, the air space having a plurality of openings along a periphery of the air space at two opposite vertical sides and in an upward direction, allowing ambient air to flow through the air space from thermally induced natural convection, wherein the air space is separated from the flue gas compartment by the flue gas compartment wall, such that the motor shaft, and thereby the motor, is cooled by the air flow through the air space both during operation of the motor and when the motor is inactive.

2. The motor-driven chimney draft system according to claim 1, wherein the air space extends parallel to the flow direction of flue gases.

3. The motor-driven chimney draft system according to claim 1, wherein the motor compartment housing the motor is situated laterally relative to the flow direction and separated from the flow of flue gases by a delimiting wall extending parallel to the flow direction, the motor shaft extending through the delimiting wall in a direction transverse to the flow direction.

4. The motor-driven chimney draft system according to claim 1, wherein the impeller drives the flue gases in radial directions of the impeller, and a screen is arranged on the delimiting wall of the flue gas compartment, the screen extending from the delimiting wall of the flue gas compartment upstream of the impeller and having a portion which on a side of the impeller opposite the delimiting wall of the flue gas compartment extends in the downstream direction and covers a peripheral portion of the impeller blades upstream of the motor shaft.

5. The motor-driven chimney draft system according to claim 4, wherein a central suction zone of the impeller is uncovered by the screen.

6. The motor-driven chimney draft system according to claim 1, wherein the flue gas compartment has a cover, which can be opened to allow access to the flue gas compartment.

7. The motor-driven chimney draft system according to claim 4, wherein a rain screen is arranged at a top wall and extends downward into the flue gas compartment, the rain screen having a lower edge which is closer to the delimiting wall than is an upper edge of the screen.

8. The motor-driven chimney draft system according to claim 4, wherein the screen has a portion extending in the downstream direction unilaterally relative to the central suction zone of the impeller.

* * * * *